US010702965B2

(12) United States Patent
Tubbs

(10) Patent No.: US 10,702,965 B2
(45) Date of Patent: Jul. 7, 2020

(54) CROSS-RECESS SCREWDRIVER GRINDING ASSEMBLY

(71) Applicant: David Tubbs, Toccoa, GA (US)

(72) Inventor: David Tubbs, Toccoa, GA (US)

( * ) Notice: Subject to any disclaimer, the term of this patent is extended or adjusted under 35 U.S.C. 154(b) by 310 days.

(21) Appl. No.: 15/924,874

(22) Filed: Mar. 19, 2018

(65) Prior Publication Data

US 2019/0283198 A1 Sep. 19, 2019

(51) Int. Cl.
*B24B 3/60* (2006.01)
*B24B 27/00* (2006.01)
*B24B 19/00* (2006.01)

(52) U.S. Cl.
CPC ..... *B24B 3/60* (2013.01); *B24B 19/00* (2013.01); *B24B 27/0076* (2013.01)

(58) Field of Classification Search
CPC ..... B24B 3/60; B24B 19/00; B24B 27/0076
USPC ..... 451/278
See application file for complete search history.

(56) References Cited

U.S. PATENT DOCUMENTS 2,249,084 A 7/1941 Kobos
2,346,300 A 4/1944 Guy
2,439,839 A 4/1948 Brulport
3,164,931 A 1/1965 Sanchez
3,803,771 A 4/1974 Bunn
4,069,619 A 1/1978 Escamilla
4,590,651 A 5/1986 Roberts
5,381,630 A * 1/1995 Kinner ..... B24B 7/17 451/63
5,400,546 A * 3/1995 Christian ..... B24B 3/26 451/138
5,735,732 A * 4/1998 Bernard ..... B24B 3/247 279/60
6,450,864 B1 * 9/2002 Smith ..... B24B 3/06 451/177
7,121,932 B2 * 10/2006 Liao ..... B24B 3/24 451/179
7,172,498 B2 * 2/2007 Bernard ..... B24B 3/24 451/231
D568,132 S * 5/2008 Heun ..... D8/63
7,473,163 B1 * 1/2009 Lee ..... B24B 3/02 451/231
2007/0243801 A1 * 10/2007 Liao ..... B24B 3/26 451/242

FOREIGN PATENT DOCUMENTS

WO WO8704962 8/1987

* cited by examiner

*Primary Examiner* — George B Nguyen

(57) ABSTRACT

A cross-recess screwdriver sharpening assembly for sharpening a cross-recess screwdriver includes a housing that has a sharpening aperture. A plurality of grinding wheels is rotatably mounted within the housing. Each of the grinding wheels is arranged to define a grinding space. A plurality of sleeves is included wherein each of the sleeves is removably extendable into the interior of the housing to have the cross-recess screwdriver positioned therethrough such that the cross-recess screwdriver extends into the housing. The sharpening aperture receives one of the sleeves therethrough and is centrally aligned with the grinding space such that the cross-recess screwdriver is extendable into the grinding space to sharpen the cross-recess screwdriver. A drive is mounted in the housing and mechanically coupled to each of the grinding wheels. The drive is turned on to rotate each of the grinding wheels.

15 Claims, 5 Drawing Sheets

CROSS-RECESS SCREWDRIVER GRINDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to grinding devices and more particularly pertains to a new grinding device for sharpening a cross-recess screwdriver.

BRIEF SUMMARY OF THE INVENTION

An embodiment of the disclosure meets the needs presented above by generally comprising a housing that has a sharpening aperture. A plurality of grinding wheels is rotatably mounted within the housing. Each of the grinding wheels is arranged to define a grinding space. A plurality of sleeves is included wherein each of the sleeves is removably extendable into the interior of the housing and configured to have the cross-recess screwdriver positioned therethrough such that the cross-recess screwdriver extends into the housing. The sharpening aperture receives one of the sleeves therethrough and is centrally aligned with the grinding space such that the cross-recess screwdriver is extendable into the grinding space to sharpen the cross-recess screwdriver. A drive is mounted in the housing and mechanically coupled to each of the grinding wheels. The drive is turned on to rotate each of the grinding wheels. A control unit is mounted on the housing and turns the drive on or off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
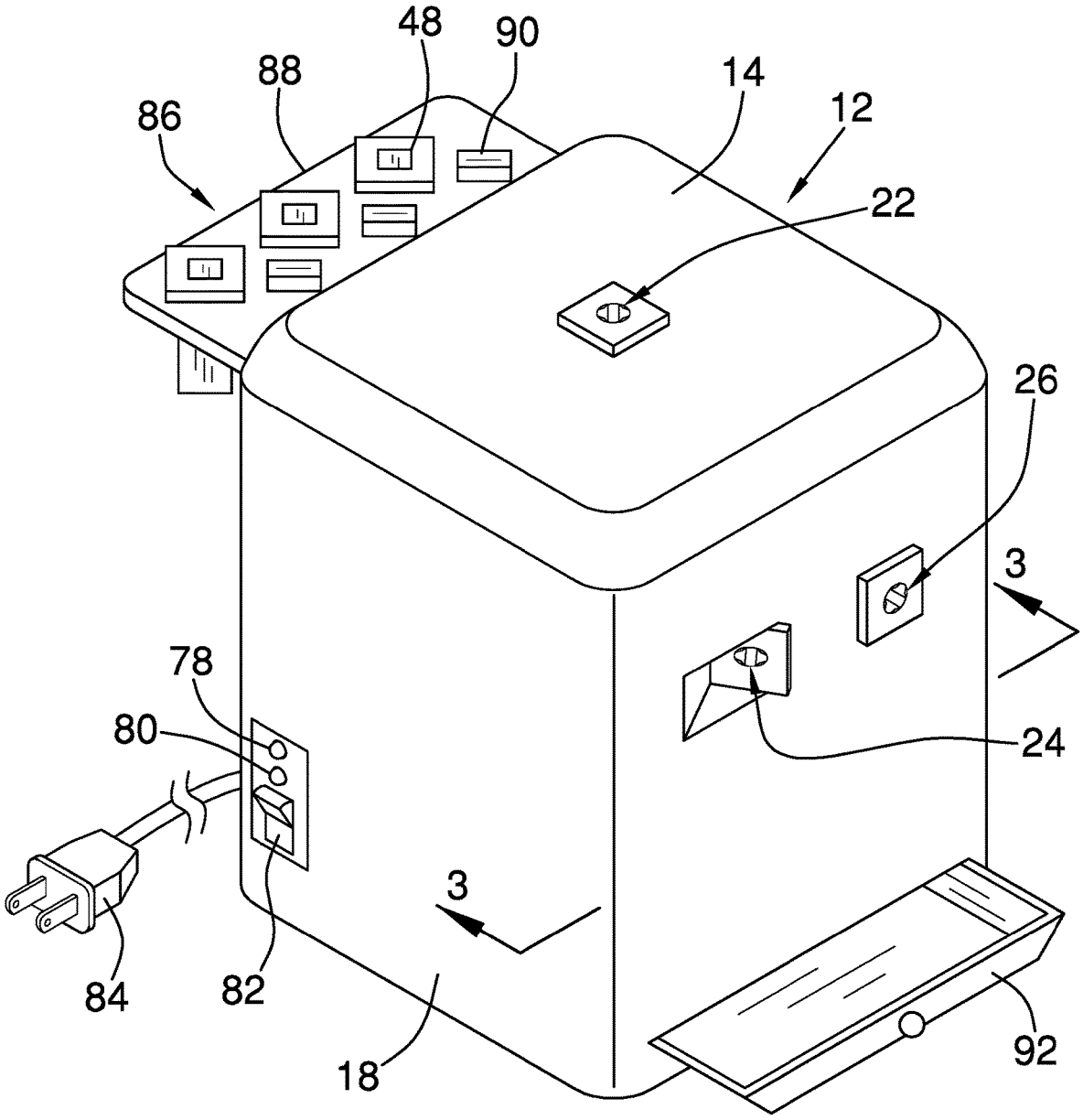
FIG. 1 is a top side view of a cross-recess screwdriver sharpening assembly according to an embodiment of the disclosure.
Figure 2:
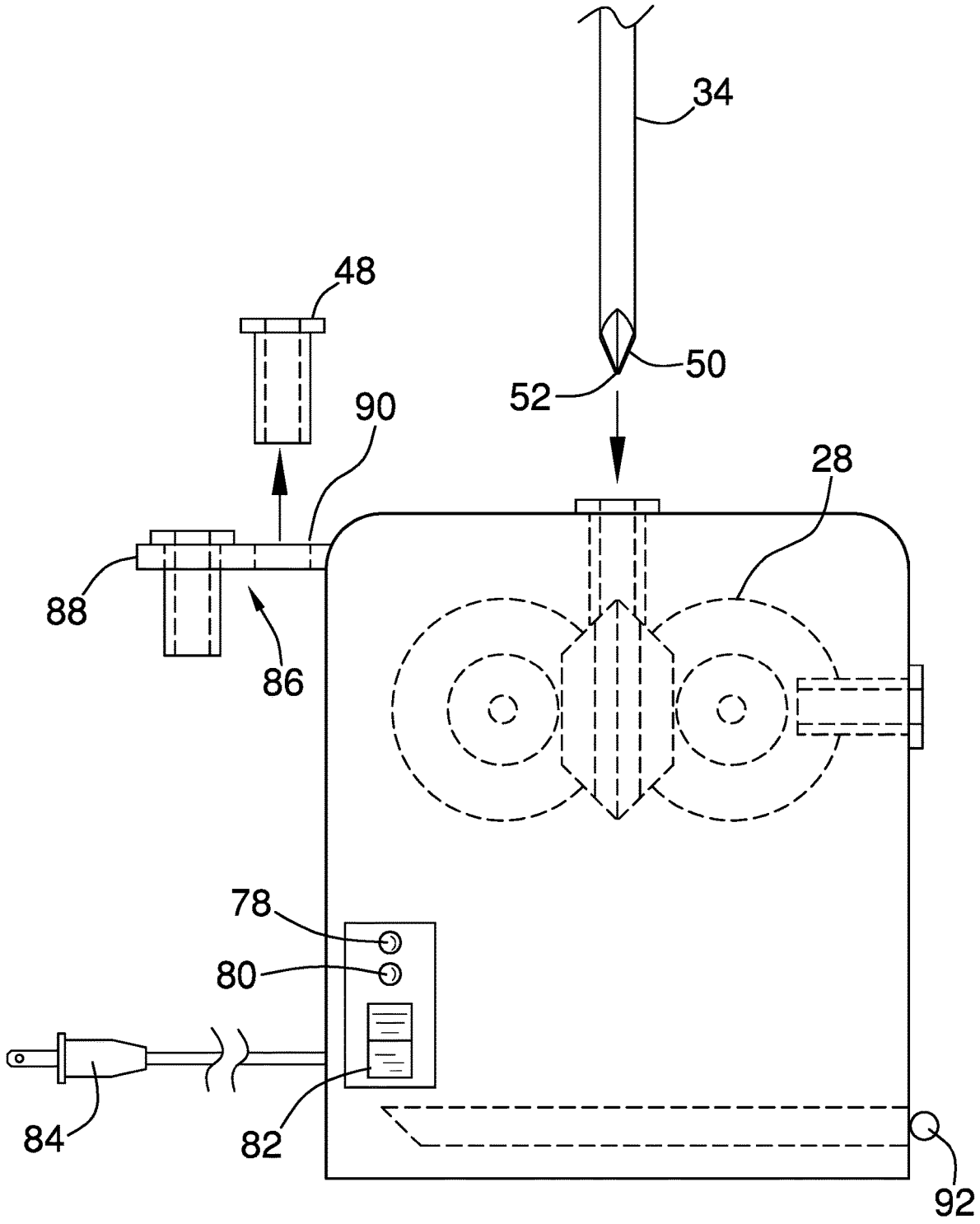
FIG. 2 is a front view of an embodiment of the disclosure.
Figure 3:
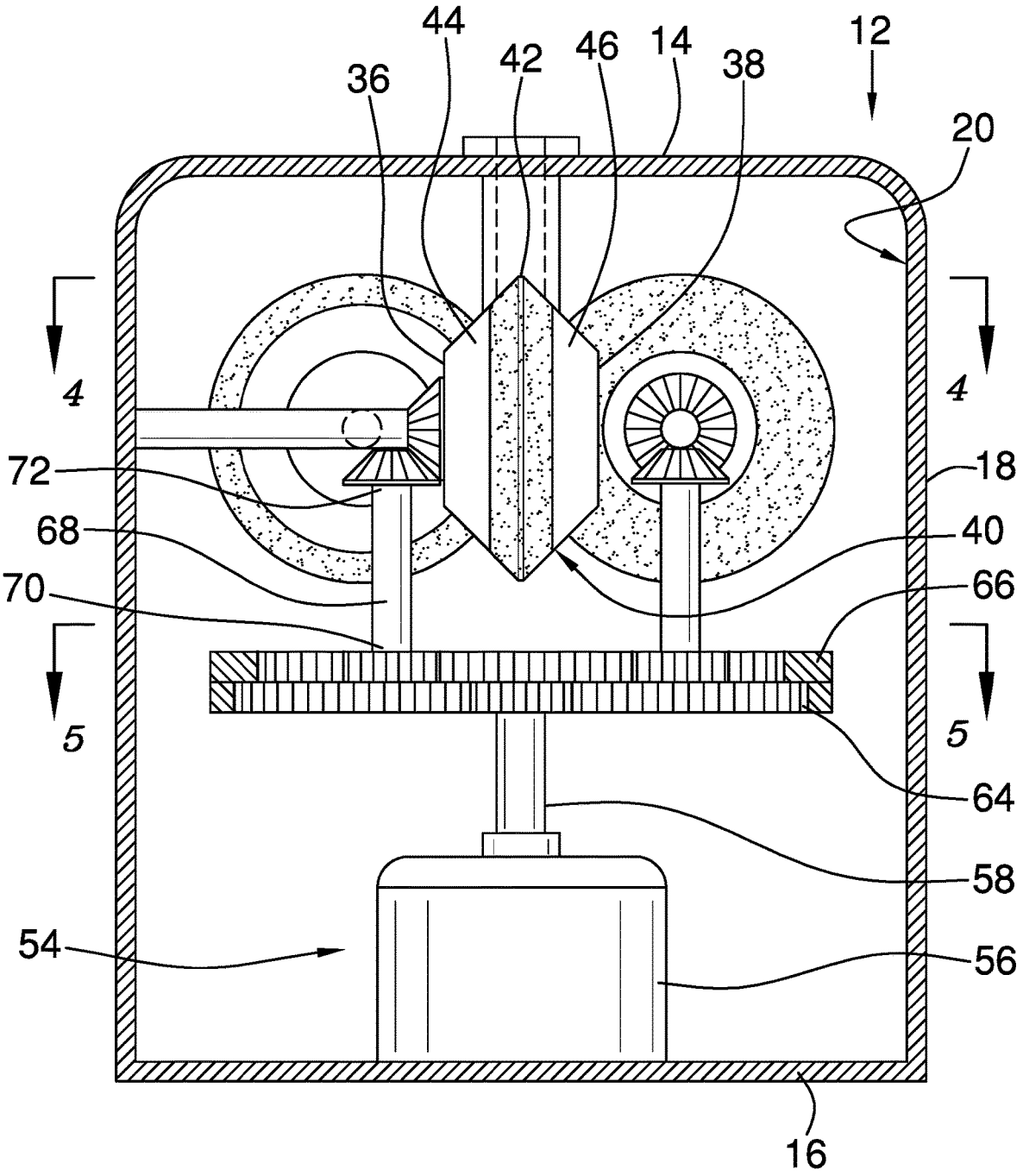
FIG. 3 is a cross-sectional view of an embodiment of the disclosure taken along line 3-3 of FIG. 1.
Figure 4:
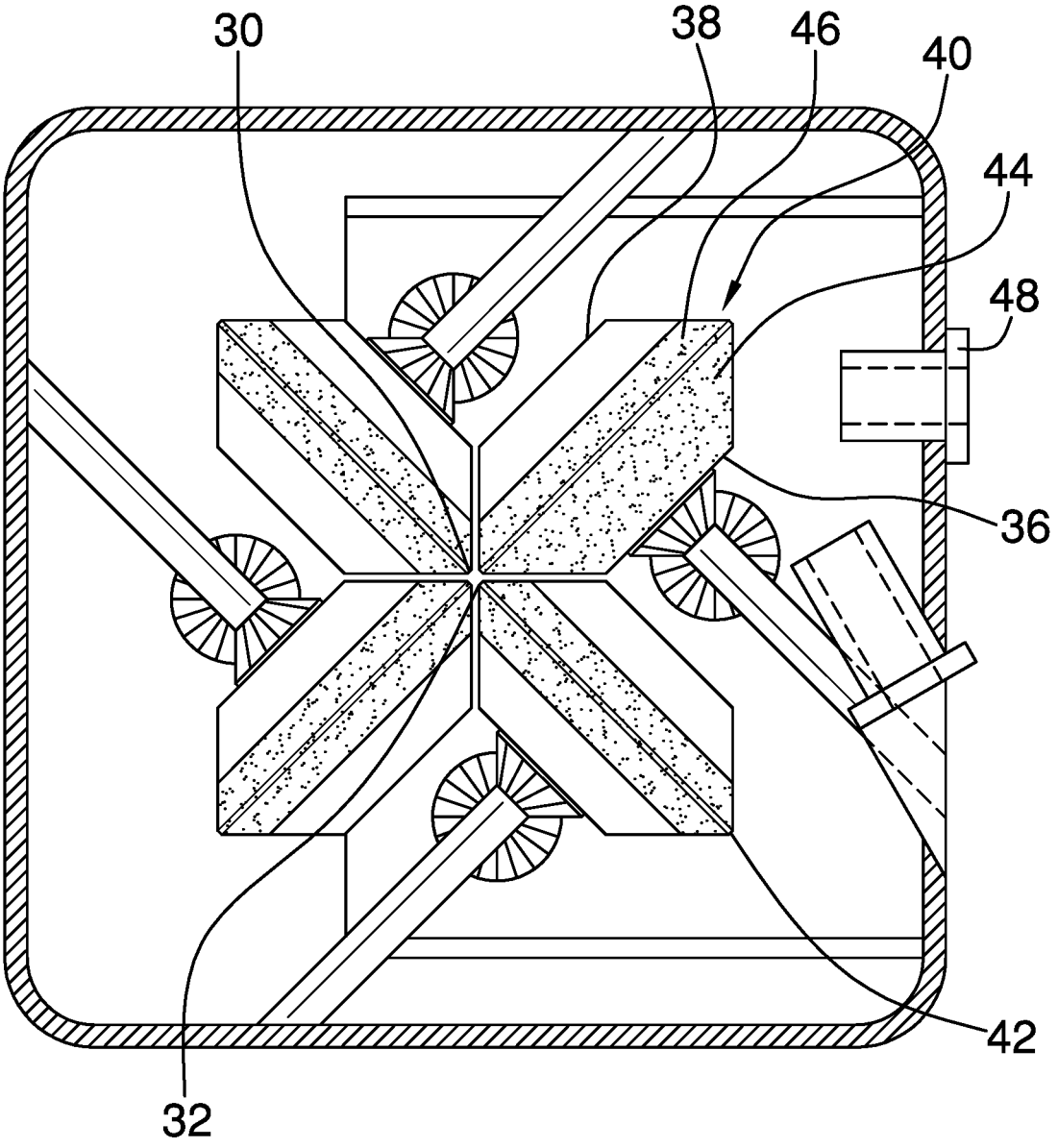
FIG. 4 is a cross-sectional view of an embodiment of the disclosure taken along line 4-4 of FIG. 3.
Figure 5:
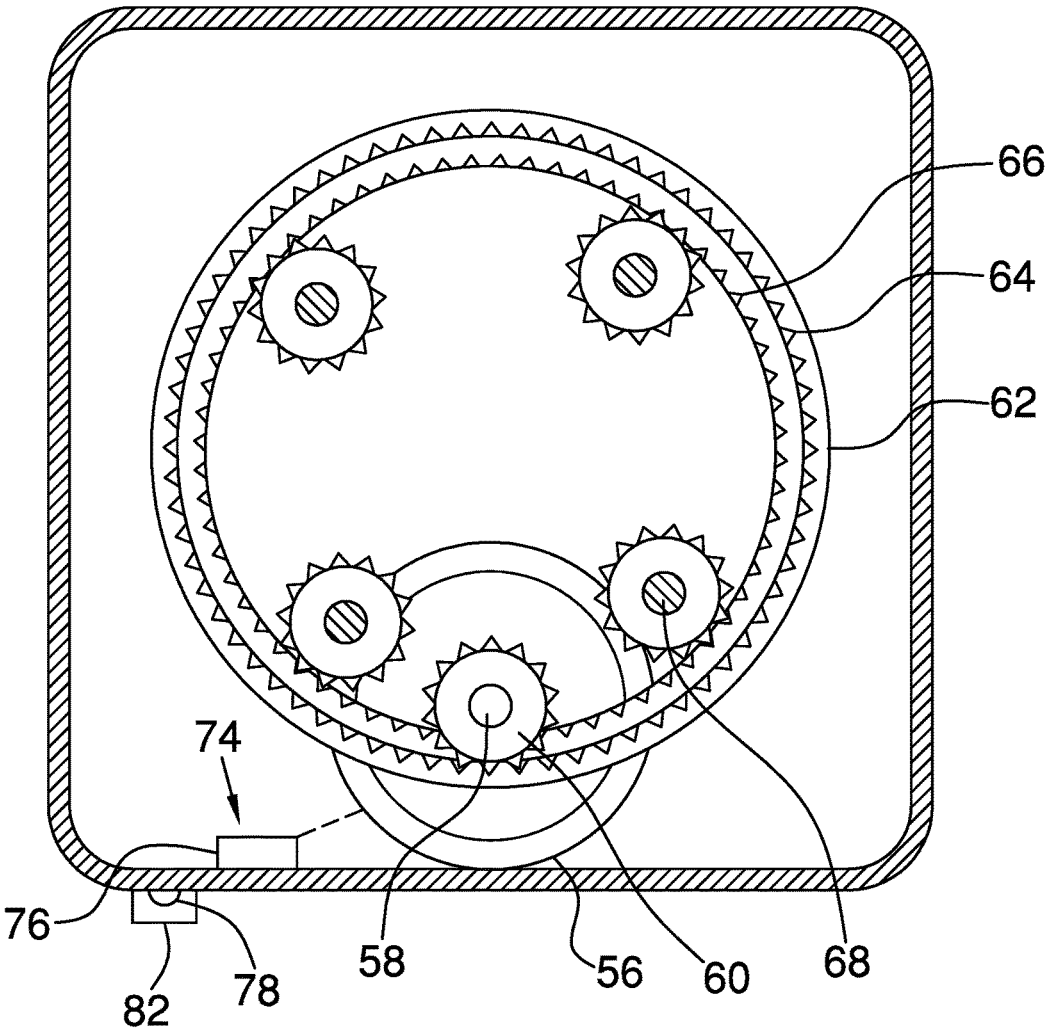
FIG. 5 is a cross-sectional view of an embodiment of the disclosure taken along line 5-5 of FIG. 3.

With reference now to the drawings, and in particular to FIGS. 1 through 5 thereof, a new grinding device embodying the principles and concepts of an embodiment of the disclosure and generally designated by the reference numeral 10 will be described.

As best illustrated in FIGS. 1 through 5, the cross-recess screwdriver sharpening assembly 10 generally comprises a housing 12 that has a top wall 14, a bottom wall 16 and a perimeter wall 18 that extends between and is attached to the top wall 14 and the bottom wall 16. The housing 12 has a plurality of receiving apertures that extend into an interior 20 of the housing 12. The receiving apertures include a sharpening aperture 22, a side flattening aperture 24, and a tip flattening aperture 26.

A plurality of grinding wheels 28 is rotatably mounted within the housing 12. Each of the grinding wheels 28 is arranged to define a grinding space 30. The term "grinding wheels" may be used to define any type of wheel used for shaping metallic shanks by cutting the shanks with a hardened steel cutting wheel or a diamond wheel.

The grinding space 30 includes a plurality of intersecting sides 32 such that the grinding space 30 has a cross-recess shape wherein the grinding space 30 receives a cross-recess screwdriver 34 that is inserted into the housing 12. Each of the grinding wheels 28 has a first surface 36, a second surface 38 and a peripheral surface 40 that extends between the first and second surfaces 36, 38. The peripheral surface 40 of each of the grinding wheels 28 has a raised edge 42 that defines a first side 44 and a second side 46 of the peripheral surface 40. Each the first sides 44 extend between an associated one of the raised edges 42 and the first surface 36 and each the second sides 46 extend between an associated one of the raised edges 42 and the second surface 38. The first side 44 of each of the grinding wheels is spaced from the second side 46 of an adjacent one of the grinding wheels 28 to define the grinding space 30.

The cross-recess shape of the grinding space 30 is defined by the position of each of the grinding wheels 28. Each of the grinding wheels 28 is positioned equidistant from the bottom wall 16 of the housing 12. In an embodiment that is comprised of four grinding wheels 28, the raised edge 42 of each of the grinding wheels 28 has an angle between 40° and 50° relative to the raised edge 42 of each adjacent grinding wheel 28. The first side 44 of each of the grinding wheels 28 is spaced from the second side 46 of an adjacent grinding wheel 28 between $1/8^{th}$ of an inch and $1/128^{th}$ of an inch. The cross-recess screwdriver 34 is extendable into the grinding space 28 as if the grinding spaces were the head of cross-recess screw. Each of the grinding wheels 28 engages the cross-recess screwdriver 34 and when spinning the grinding wheels 28 sharpen the cross-recess screwdriver 34.

A plurality of sleeves 48 is included wherein each of the sleeves 48 is removably extendable into the interior 20 of the housing 12. Each of the sleeves 48 has the cross-recess screwdriver 34 positioned therethrough such that the cross-recess screwdriver 34 extends into the housing 12. Each of the sleeves 48 has a unique interior diameter with respect to other ones of the sleeves 48 to accommodate a variety of sizes, or shanks, of screwdrivers 34. The sizes of screwdrivers include but are not limited to #0, #1, #2 and #3 but could also include screwdrivers used conventionally to fix jewelry as well as other sizes. Moreover, each of the sleeves 48 may have an interior diameter between ½ inches and 1/32 inches to receive the shaft of the screwdriver 34. Each sleeve 34 may be assigned a corresponding one of said apertures 22, 24, 26 wherein a length of the sleeve is different based on which aperture the sleeve corresponds to. Additionally, three sleeves 34 may be formed to accommodate round shanked screwdrivers while three sleeves are designed to accommodate square shanked shaped 34.

The sharpening aperture 22 receives one of the sleeves 48 therethrough. The sharpening aperture 22 is centrally aligned with the grinding space 30 such that the cross-recess screwdriver 34 is extendable into the grinding space 30. Each of the raised edges 42 sharpens the cross-recess screwdriver 34 when spinning.

The side flattening aperture 24 receives one of the sleeves 48 therethrough. The side flattening aperture 24 is orientated at an acute inside angle with the first side 44 of one of the grinding wheels 28 wherein the side flattening aperture 24 grinds a side 50 of the cross-recess screwdriver 34 extended therethrough.

The tip flattening aperture 26 receives one of the sleeves 48 therethrough. The tip flattening aperture 26 is orientated at a perpendicular angle with the first side 44 of one of the grinding wheels 28 wherein the tip flattening aperture 26 grinds a tip 52 of the cross-recess screwdriver 34 extended therethrough.

A drive 54 is mounted in the housing 12 and is mechanically coupled to each of the grinding wheels 28. The drive 54 is turned on to rotate each of the grinding wheels 28. The drive 54 may comprise a motor 56 mounted in the housing 12. A drive rod 58 mechanically coupled to the motor 56 and rotates when said motor 56 is turned on. The drive rod 58 is in mechanical communication with each of the grinding wheels 28 to rotate the grinding wheels 28.

In one embodiment the drive rod 58 may be mechanically coupled to a coupling gear 60. A ring gear 62 is included and has a first set of teeth 64 and a second set of teeth 66. The coupling gear 60 is mechanically coupled to the first set of teeth 64 such that the ring gear 62 rotates when the drive rod 58 rotates. A plurality of shafts 68 is included wherein each of the shafts 68 has a first end 70 and a second end 72. Each of the first ends 70 is mechanically coupled to the second set of teeth 66. Each of the second ends 72 is mechanically coupled to one of the grinding wheels 28 such that when said motor 56 is turned on the shafts 68 rotate an associated one of said grinding wheels 28.

A control unit 74 is mounted on the housing 12. The control unit 74 turns the drive 54 on or off. The control unit 74 comprises a control circuit 76 that is electrically coupled to the drive 54. A speed indicator light 78 is electrically coupled to the control circuit 76 and emits a visible light when the grinding wheels 28 rotate at a threshold speed. A power indicator light 80 is electrically coupled to the control circuit 76 and emits a visible light when the drive 54 is turned on. A power switch 82 is electrically coupled to the control circuit 76 and is actuated to turn the drive 54 on or off. A power supply 84 is electrically coupled to the control circuit 76 and may comprise a power plug that is plugged into a power source.

A sleeve storage 86 is coupled to the housing 12. Each of said sleeves 48 is storable on the sleeve storage 86. The sleeve storage 86 comprises a panel 88 that has a plurality of openings 90 that extend therethrough. Each of the sleeves 48 is positionable through one of said openings 90.

A collecting tray 92 is insertably received by said housing 12. The collecting tray 92 collects metal scraps that are shaved off of the cross-recess screwdriver 34. The collecting tray 92 is removed from the interior 20 of the housing 12 to empty the scraps outwardly from the housing 12.

In use, the control unit 74 is actuated to turn the drive on 54. The drive 54 rotates each of the grinding wheels 28. The cross-recess screwdriver 34 is inserted into a selected one of the apertures. The cross-recess screwdriver 34 engages the grinding wheels 28 to grind the cross-recess screwdriver 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cross-recess screwdriver sharpening assembly comprising:

a housing having a sharpening aperture;

a plurality of grinding wheels being rotatably mounted within said housing, each of said grinding wheels being arranged to define a grinding space;

a plurality of sleeves, each of said sleeves being removably extendable into said interior of said housing, each of said sleeves being configured to have the cross-recess screwdriver positioned therethrough such that the cross-recess screwdriver extends into said housing;

said sharpening aperture receiving one of said sleeves therethrough, said sharpening aperture being centrally aligned with said grinding space such that the cross-recess screwdriver is extendable into said grinding space to sharpen the cross-recess screwdriver;

a drive being mounted in said housing and mechanically coupled to each of said grinding wheels, said drive being turned on to rotate each of said grinding wheels; and a control unit being mounted on said housing, said control unit turning said drive on or off.

2. The cross-recess screwdriver sharpening assembly according to claim 1, wherein said housing has a top wall, a bottom wall and a perimeter wall extending between and being attached to said top wall and said bottom wall.

3. The cross-recess screwdriver sharpening assembly according to claim 2, wherein said housing has a plurality of receiving apertures extending into an interior of said housing, said receiving apertures including a sharpening aperture, a side flattening aperture, and a tip flattening aperture.

4. The cross-recess screwdriver sharpening assembly according to claim 3, wherein said grinding space includes a plurality of intersecting sides such that said grinding space has a cross-recess shape wherein said grinding space is configured to receive a cross-recess screwdriver that is inserted into said housing.

5. The cross-recess screwdriver sharpening assembly according to claim 4, wherein each of said grinding wheels has a first surface, a second surface and a peripheral surface extending between said first and second surfaces, said peripheral surface of each of said grinding wheels having a raised edge.

6. The cross-recess screwdriver sharpening assembly according to claim 5, wherein said raised edge of each of said grinding wheels defines a first side and a second side of said peripheral surface.

7. The cross-recess screwdriver sharpening assembly according to claim 6, wherein each said first sides extends between an associated one of said raised edge and said first surface, each said second sides extending between an associated one of said raised edge and said second surface.

8. The cross-recess screwdriver sharpening assembly according to claim 7, wherein said first side of each of said grinding wheels is spaced from said second side of an adjacent one of said grinding wheels to define said grinding space.

9. The cross-recess screwdriver sharpening assembly according to claim 8, wherein each of said sleeves has a unique interior diameter with respect to other ones of said sleeves to accommodate a variety of sizes of screwdrivers.

10. The cross-recess screwdriver sharpening assembly according to claim 9, wherein each of said raised edges is configured to sharpen the cross-recess screwdriver when spinning.

11. The cross-recess screwdriver sharpening assembly according to claim 10, wherein said side flattening aperture receives one of said sleeves therethrough, said side flattening aperture being orientated at an acute inside angle with said first side of one of said grinding wheels wherein said side flattening aperture is configured to grind a side of the cross-recess screwdriver extended therethrough.

12. The cross-recess screwdriver sharpening assembly according to claim 10, wherein said tip flattening aperture receiving one of said sleeves therethrough, said tip flattening aperture being orientated at a perpendicular angle with said first side of one of said grinding wheels wherein said tip flattening aperture is configured to grind a tip of the cross-recess screwdriver extended therethrough.

13. The cross-recess screwdriver sharpening assembly according to claim 1, where said control unit comprises:

a control circuit being electrically coupled to said drive;

a speed indicator light being electrically coupled to said control circuit, said speed indicator light emitting a visible light when said grinding wheels rotate at a threshold speed; and a power indicator light being electrically coupled to said control circuit, said power indicator light emitting a visible light when said drive is turned on.

14. The cross-recess screwdriver sharpening assembly according to claim 13, where said control unit further comprises:

a power switch being electrically coupled to said control circuit, said power switch being actuated to turn said drive on or off; and a power supply being electrically coupled to said control circuit, said power supply comprising a power plug being configured to be plugged into a power source.

15. A cross-recess screwdriver sharpening assembly comprising:

a housing having a top wall, a bottom wall and a perimeter wall extending between and being attached to said top wall and said bottom wall, said housing having a plurality of receiving apertures extending into an interior of said housing, said receiving apertures including a sharpening aperture, a side flattening aperture, and a tip flattening aperture;

a plurality of grinding wheels being rotatably mounted within said housing, each of said grinding wheels being arranged to define a grinding space, said grinding space including a plurality of intersecting sides such that said grinding space has a cross-recess shape wherein said grinding space is configured to receive a cross-recess screwdriver that is inserted into said housing, each of said grinding wheels having a first surface, a second surface and a peripheral surface extending between said first and second surfaces, said peripheral surface of each of said grinding wheels having a raised edge, said raised edge of each of said grinding wheels defining a first side and a second side of said peripheral surface, each said first sides extending between an associated one of said raised edge and said first surface, each said second sides extending between an associated one of said raised edge and said second surface, said first side of each of said grinding wheels being spaced from said second side of an adjacent one of said grinding wheels to define said grinding space;

a plurality of sleeves, each of said sleeves being removably extendable into said interior of said housing, each of said sleeves being configured to have the cross-recess screwdriver positioned therethrough such that the cross-recess screwdriver extends into said housing, each of said sleeves having a unique interior diameter and shape with respect to other ones of said sleeves to accommodate a variety of shanks of screwdrivers;

said sharpening aperture receiving one of said sleeves therethrough, said sharpening aperture being centrally aligned with said grinding space such that the cross-recess screwdriver is extendable into said grinding space, each of said raised edges being configured to sharpen the cross-recess screwdriver when spinning;

said side flattening aperture receiving one of said sleeves therethrough, said side flattening aperture being orientated at an acute inside angle with said first side of one of said grinding wheels wherein said side flattening aperture is configured to grind a side of the cross-recess screwdriver extended therethrough;

said tip flattening aperture receiving one of said sleeves therethrough, said tip flattening aperture being orientated at a perpendicular angle with said first side of one of said grinding wheels wherein said tip flattening aperture is configured to grind a tip of the cross-recess screwdriver extended therethrough;

a drive being mounted in said housing and mechanically coupled to each of said grinding wheels, said drive being turned on to rotate each of said grinding wheels;

a control unit being mounted on said housing, said control unit turning said drive on or off, said control unit comprising:

a control circuit being electrically coupled to said drive;

a speed indicator light being electrically coupled to said control circuit, said speed indicator light emitting a visible light when said grinding wheels rotate at a threshold speed;

a power indicator light being electrically coupled to said control circuit, said power indicator light emitting a visible light when said drive is turned on;

a power switch being electrically coupled to said control circuit, said power switch being actuated to turn said drive on or off; and a power supply being electrically coupled to said control circuit, said power supply comprising a power plug being configured to be plugged into a power source.

* * * * *